US009809438B2

(12) United States Patent
Broodryk

(10) Patent No.: US 9,809,438 B2
(45) Date of Patent: Nov. 7, 2017

(54) FLUID DISPENSING APPARATUS AND SYSTEM

(71) Applicant: Quickflow Beverage Technology (Pty) Ltd., Cape Town (ZA)

(72) Inventor: Bergen Broodryk, Cape Town (ZA)

(73) Assignee: Quickflow Beverage Technology (Pty) Ltd., Cape Town (ZA)

( * ) Notice: Subject to any disclaimer, the term of this patent is extended or adjusted under 35 U.S.C. 154(b) by 21 days.

(21) Appl. No.: 15/103,710

(22) PCT Filed: Dec. 10, 2014

(86) PCT No.: PCT/ZA2014/000074
§ 371 (c)(1),
(2) Date: Jun. 10, 2016

(87) PCT Pub. No.: WO2015/139062
PCT Pub. Date: Sep. 17, 2015

(65) Prior Publication Data

US 2016/0297664 A1 Oct. 13, 2016

(30) Foreign Application Priority Data

Dec. 11, 2013 (ZA) ..... 2013/09313

(51) Int. Cl.
*B67D 1/00* (2006.01)
*B67D 1/04* (2006.01)
(Continued)

(52) U.S. Cl.
CPC ..... *B67D 1/0418* (2013.01); *B67D 1/0021* (2013.01); *B67D 1/0079* (2013.01); *B67D 1/125* (2013.01); *B67D 3/0035* (2013.01)

(58) Field of Classification Search
CPC .. B67D 1/0418; B67D 1/0021; B67D 1/0079; B67D 1/125; B67D 1/12; B67D 1/1252; B67D 3/0035; B67D 3/0032
(Continued)

(56) References Cited

U.S. PATENT DOCUMENTS 999,602 A 5/1911 Slee
1,241,352 A 9/1917 Doerning, Jr. et al.
(Continued)

FOREIGN PATENT DOCUMENTS

EP 0515643 2/1996
WO 2013027204 2/2013

OTHER PUBLICATIONS

Written Opinion issued in International Application No. PCT/ZA2014/000074 dated Jun. 23, 2015.

*Primary Examiner* — Lien Ngo
(74) *Attorney, Agent, or Firm* — Haugen Law Firm PLLP

(57) ABSTRACT

A fluid dispensing apparatus includes:

a cap, a container, a cover on the cap for regulating flow of fluid from the container on which the cap is secured through the cap; a seat for receiving the cap or the container to which the cap is secured therein; second securing means for securing either the cap or the container to which the cap is secured to the seat; a probe located within the seat for protruding through the cover when the cap or a container to which the cap is secured is received in the seat, and thereby permitting access to the interior of the container; a gas conduit for charging a container associated with the cap with gas; a gas valve for regulating flow of gas through the gas conduit; and a sensor for sensing whether a container or cap is secured to the seat which sensor causes the gas
(Continued)

valve to open when the container or cap is secured to the seat; and close when the container or cap is not secured to the seat.

18 Claims, 7 Drawing Sheets

(51) Int. Cl.
*B67D 3/00* (2006.01)
*B67D 1/12* (2006.01)

(58) Field of Classification Search
USPC ..... 222/61, 20, 165, 166, 185.1, 181.5, 222/325–327
See application file for complete search history.

(56) References Cited

U.S. PATENT DOCUMENTS 4,408,701 A 10/1983 Jeans
5,031,676 A 7/1991 Ulm
5,370,270 A 12/1994 Adams
5,413,152 A 5/1995 Burrows
5,425,404 A 6/1995 Dyer
5,947,339 A * 9/1999 Boshears ..... B67D 1/0425 222/135
7,690,392 B1 * 4/2010 Sarkiss ..... B01F 5/0413 137/205.5
8,007,666 B1 * 8/2011 Davis ..... C02F 1/78 210/192
2005/0067434 A1 3/2005 Yu
2005/0173453 A1 8/2005 Azodi
2007/0181602 A1 * 8/2007 Taradalsky ..... B67D 1/04 222/152
2009/0008357 A1 * 1/2009 Azodi ..... B67B 7/26 215/316
2012/0291627 A1 * 11/2012 Tom ..... B67D 7/0261 95/8
2016/0009536 A1 * 1/2016 Orita ..... B67D 1/07 222/92

* cited by examiner

FLUID DISPENSING APPARATUS AND SYSTEM

BACKGROUND

The present invention relates to a fluid dispending apparatus and system. More particularly, the present invention relates to apparatus and a system for connecting inverted beverage bottles to a beverage fountain.

Fluid distribution systems for distributing fluid from inverted containers are known. For instance:

WO2013/027204 "Carbonated drink dispenser and method" describes a dispenser for receiving and securing the mouth of a bottle directly therein.

EP0515643 "Syrup dispenser valve assembly", WO94/24040 "Gravity feed fluid dispensing system", U.S. Pat. No. 999,602 "Liquid dispensing apparatus", U.S. Pat. No. 1,241,352 "Water dispensing device", U.S. Pat. No. 5,370,270 "Non-spill bottle cap used with water dispensers", U.S. Pat. No. 5,031,676 "Decap dispensing system for water cooler bottles", U.S. Pat. No. 5,413,152 "Bottle cap and valve assembly for a bottled water station" and US2005/0067434 "Water bottle cap" describe a dispensing system comprising a container, a cap for closing the mouth of the container, a valve or frangible cover on the cap for regulating flow of fluid through the cap, and a seat for receiving and securing the mouth of the container therein.

A drawback of prior art dispensing systems is that they are not particularly suited to dispense carbonated fluid.

The dispensing apparatus and system according to the present invention aims to provide apparatus and a system whereby securing of the bottle to the seat automatically charges the bottle with gas.

SUMMARY OF THE INVENTION

According to a preferred embodiment of a first aspect of the present invention, a fluid dispensing apparatus includes:

- a cap for covering the mouth of a container;
- first securing means for, in use, securing the cap to the mouth of a container;
- a cover on the cap for, in use, regulating flow of fluid from a container on which the cap is secured through the cap;
- a seat for, in use, receiving the cap or a container to which the cap is secured therein;
- second securing means for, in use, securing either the cap or a container to which the cap is secured to the seat;
- a probe located within the seat for, in use, protruding through the sover when the cap or a container to which the cap is secured is received in the seat, and thereby permitting access to the interior of the container;
- a gas conduit for, in use, charging a container associated with the cap with gas;
- a gas valve for regulating flow of gas through the gas conduit; and
- a sensor for sensing whether a container or cap is secured to the seat, which sensor causes the gas valve to: (i) open when the container or cap is secured to the seat; and (ii) close when the container or cap is not secured to the seat.

Preferably, the cover is a cap valve that is movable between: (i) a closed condition in which the cap valve prevents access to the interior of the container and seals the container; and (ii) an open condition in which the cap valve permits access to the interior of the container, and wherein, in use, protrusion of the probe into the container causes the cap valve to move towards the open condition.

Typically, the sensor comprises a formation on the cap that co-operates with a formation on the seat or the probe to open the gas valve when the container or cap is secured to the seat.

Generally, the formation on the cap is a radially projecting tab.

Preferably, the gas conduit extends at least partially along the probe.

Typically, the fluid dispensing apparatus further includes a fluid outlet conduit that extends at least partially along the probe.

Generally, the fluid dispensing apparatus further includes a flow regulator that is located along the fluid outlet conduit.

Optionally, the flow regulator comprises: (i) a portion of the fluid outlet conduit; (ii) a subsidiary branch conduit that is in fluid communication with the portion of the fluid outlet conduit, the subsidiary branch conduit terminating in a waste fluid discharge outlet; and (ii) at least one buoyant ball trapped within the subsidiary branch conduit. The flow regulator may also further: (i) define an antechamber along the portion of the fluid outlet conduit; and (ii) include a ball with a specific gravity greater than 1 located within the antechamber.

Preferably, the fluid dispending apparatus further includes a one-way valve located along the fluid outlet conduit.

Typically, the first securing means comprises a female threaded portion for, in use, co-operating with a male threaded portion adjacent the mouth of a container.

Generally, the second securing means comprises the radially projecting tab on the cap, which tab co-operates with a receiving formation defined by the seat.

Preferably, the receiving formation defined by the seat is a groove sized to receive the radially projecting tab on the cap therein and therealong.

Typically, the cap valve comprises an aperture defined by the cap and a cover that is hingedly connected to the cap for covering the aperture.

Generally, the gas conduit is connected at one end to a pressurised carbon dioxide gas cylinder.

Preferably, the container is a bottle. More preferably, the container is a 2, 1.5, 5, 10 or 20 liter bottle.

According to a preferred embodiment of a second aspect of the present invention, a fluid dispensing system includes at least two fluid dispensing apparatuses according to the first aspect of the invention and a manifold for combining the at least two fluid outlet conduits into a single fluid conduit that terminates at its operative downstream end in a fluid dispensing tap.

Typically, the fluid dispensing system further includes a base: (i) on which at least two seats are located; or (ii) that defines at least two seats.

Generally, the fluid dispensing system further includes a refrigerated container for, in use, housing at least two containers associated with the at least two caps.

BRIEF DESCRIPTION OF THE DRAWINGS

The fluid dispensing apparatus and system will now be described in more detail, by way of example only, with reference to the accompanying drawings, in which.

DESCRIPTION OF THE INVENTION

Figure 1:
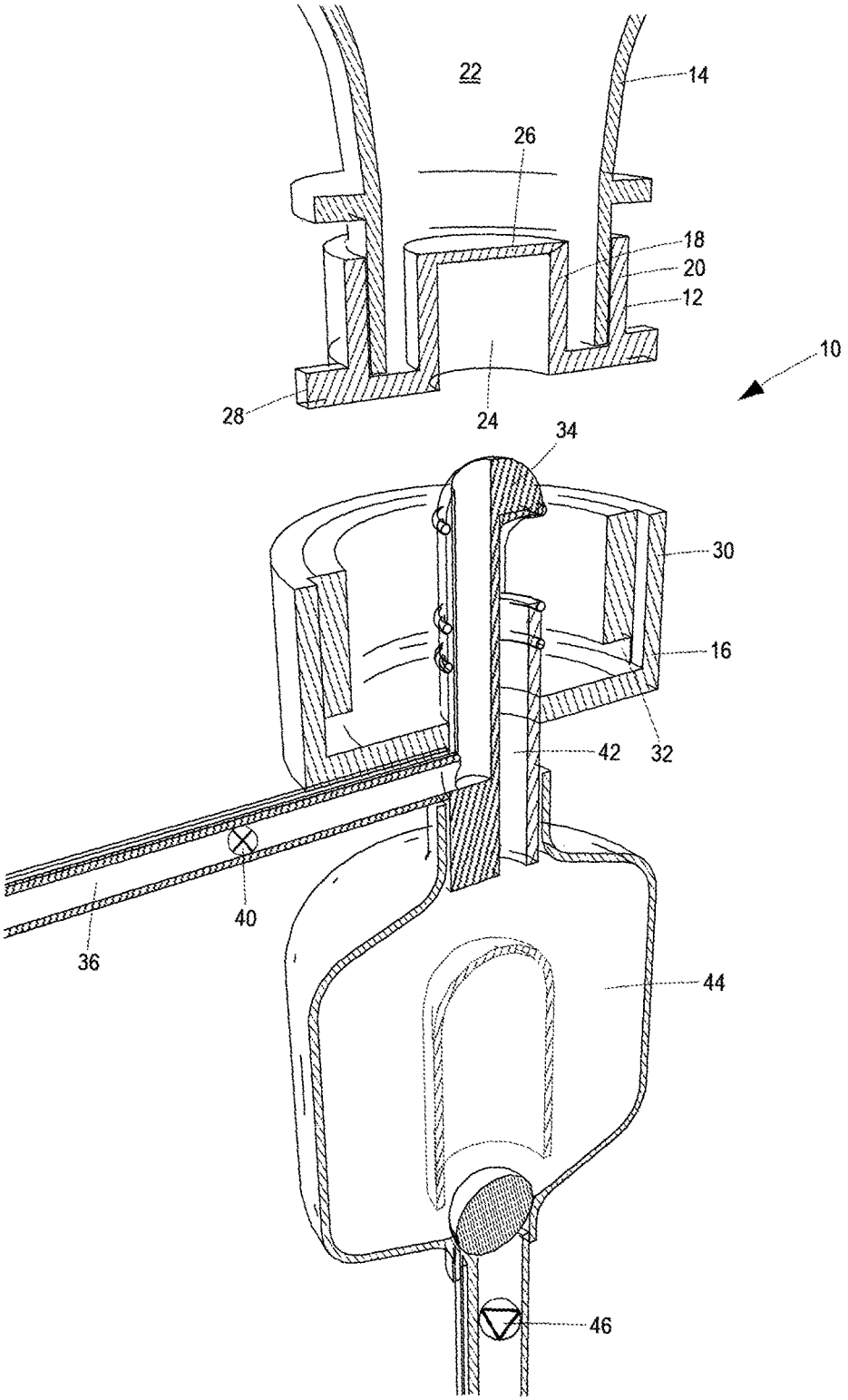
FIG. 1 is a cross-sectional perspective view of a fluid dispensing apparatus according to a first aspect of the invention.
Figure 2:
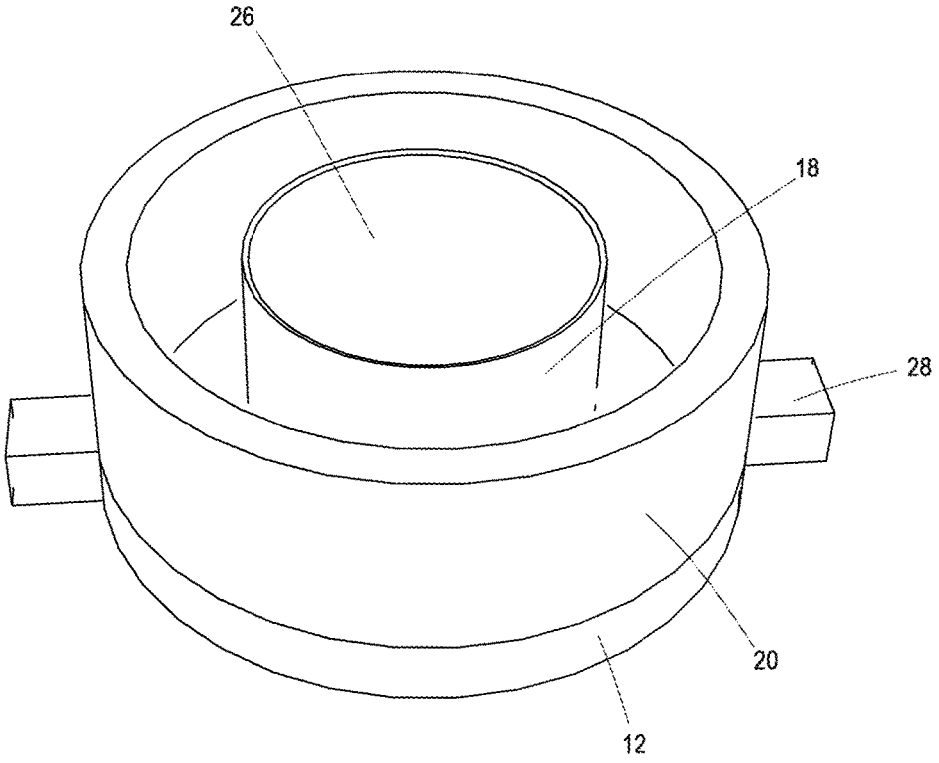
FIG. 2 is a perspective view of the cap of the fluid dispensing apparatus in FIG. 1.
Figure 3:
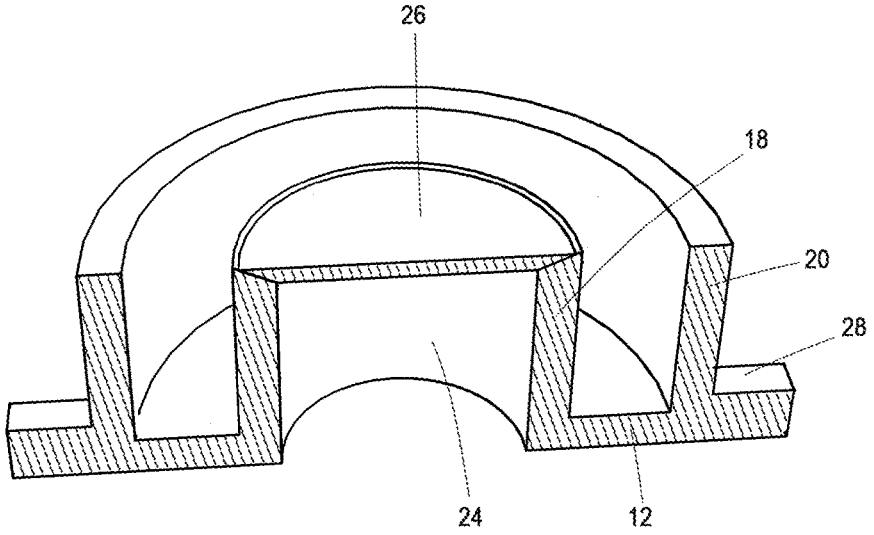
FIG. 3 is a cross-sectional perspective view of the cap of the fluid dispensing apparatus in FIG. 1.
Figure 4:
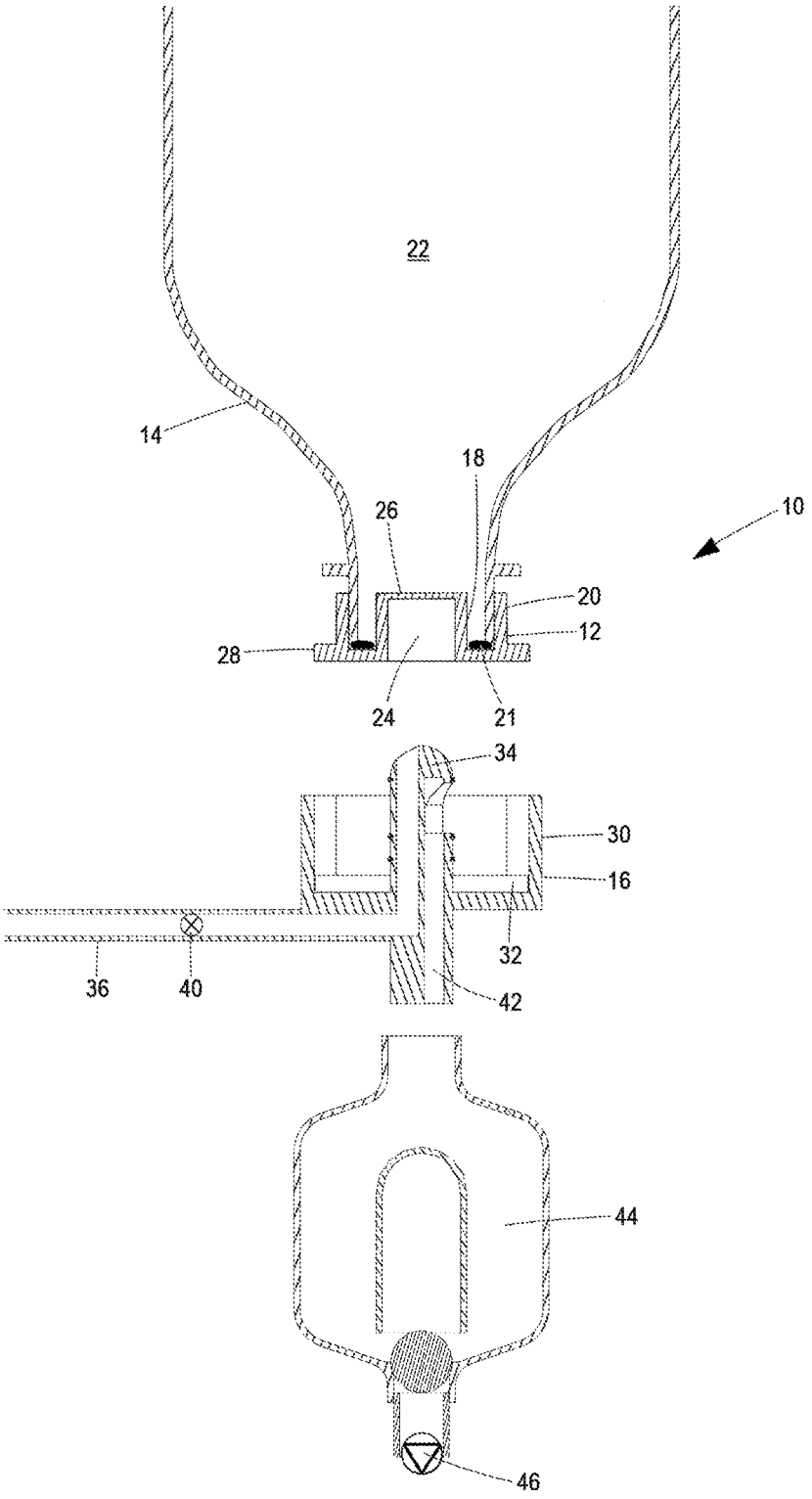
FIG. 4 is a cross-sectional side view of the cap and seat of the fluid dispensing apparatus in FIG. 1 with the cap not secured to the seat.
Figure 5:
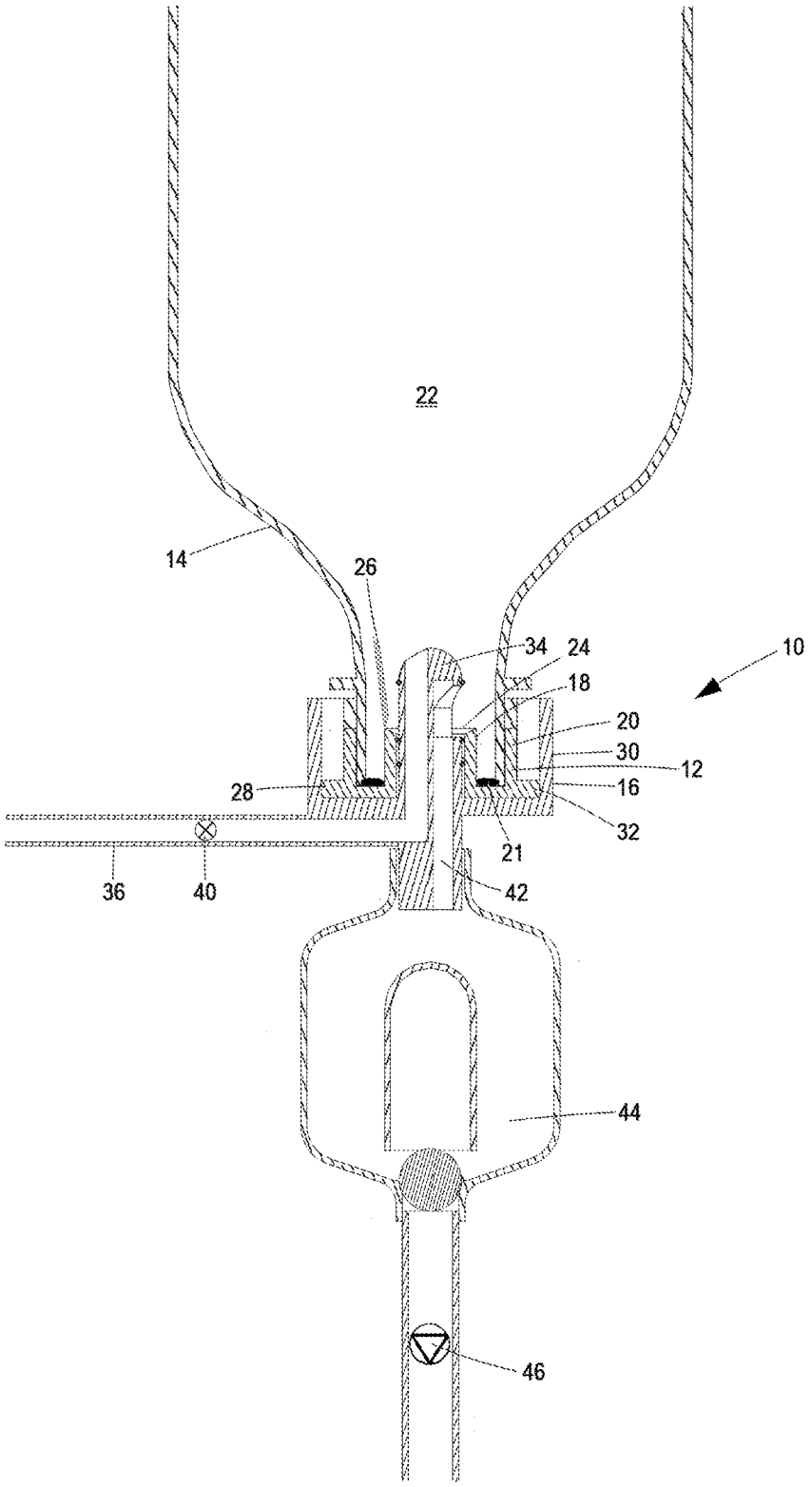
FIG. 5 is a cross-sectional side view of the cap and seat of the fluid dispensing apparatus in FIG. 1 with the cap secured to the seat.

With reference to FIGS. 1 to 5, a fluid dispensing apparatus 10 includes a cap 12 for a container 14 and a seat 16 for receiving the cap 12 and container 14 therein.

The container 14 is a standard 1.5 liter or 2 liter carbonated beverage bottle with a male threaded portion adjacent the mouth of the bottle. Although the invention has been described with reference to 1.5 liter and 2 liter bottles, it will be appreciated that bottles 14 of different volumes (e.g. 5, 10, 15 and 20 liter bottles) may also be used.

The cap 12 comprises two right circular cylindrical sections 18 and 20—the inner cylindrical section 18 is sized to be received within the mouth of the bottle 14, and the outer cylindrical section 20 is sized to locate outside the mouth of the bottle 14. The outer cylindrical section 20 defines a female threaded portion for co-operating with the male threaded portion on the bottle 14 to secure the cap 12 to the bottle 14. An elastomeric seal 21 is located between the inner and outer cylindrical sections 18 and 20 to prevent leakage of fluid 22 from the bottle 14 when the bottle 14 and cap 12 are threadably secured to one another.

The threaded portions on the outer cylindrical section 20 of the cap 12 and on the bottle 14 comprise the first securing means.

The cap 12 defines an aperture 24 at its longitudinal axis, which aperture 24 is closed by a cover 26. The cover 26 is hingedly connected to the cap 12 and is oversized relative to the aperture 24 so as to act as a valve and seal the aperture 24, preventing fluid 22 leaking from the container 14 when the container 14 is inverted. It will be appreciated that although the cover 26 has been described and illustrated as a hinged valve, the cover 26 could alternatively comprise a removable/tearable seal for the aperture 24, i.e. being either removably secured to the cap 12 or tearable along a frangible line.

The cap 12 also includes a pair of radially protruding tabs 28.

The seat 16 defines a cavity bounded by a right circular cylindrical wall 30 and includes a seal (not shown) at the base of the cylindrical wall 30. The cavity defined by the seat 16 is sized and shaped to receive the cap 12 therein. The cylindrical wall 30 also defines a pair of grooves 32, which grooves are sized and shaped to receive the radially protruding tabs 28 therein and therealong. The grooves 32 defined by the seat 16 and the radially protruding tabs 28 on the cap 12 comprise the second securing means for securing the cap 12 to the seat 16.

It will be appreciated that, although the seat 16 has been described as receiving the cap 12 therein, the seat could alternatively be arranged to receive and secure the bottle 14 mouth therein.

Figure 6:
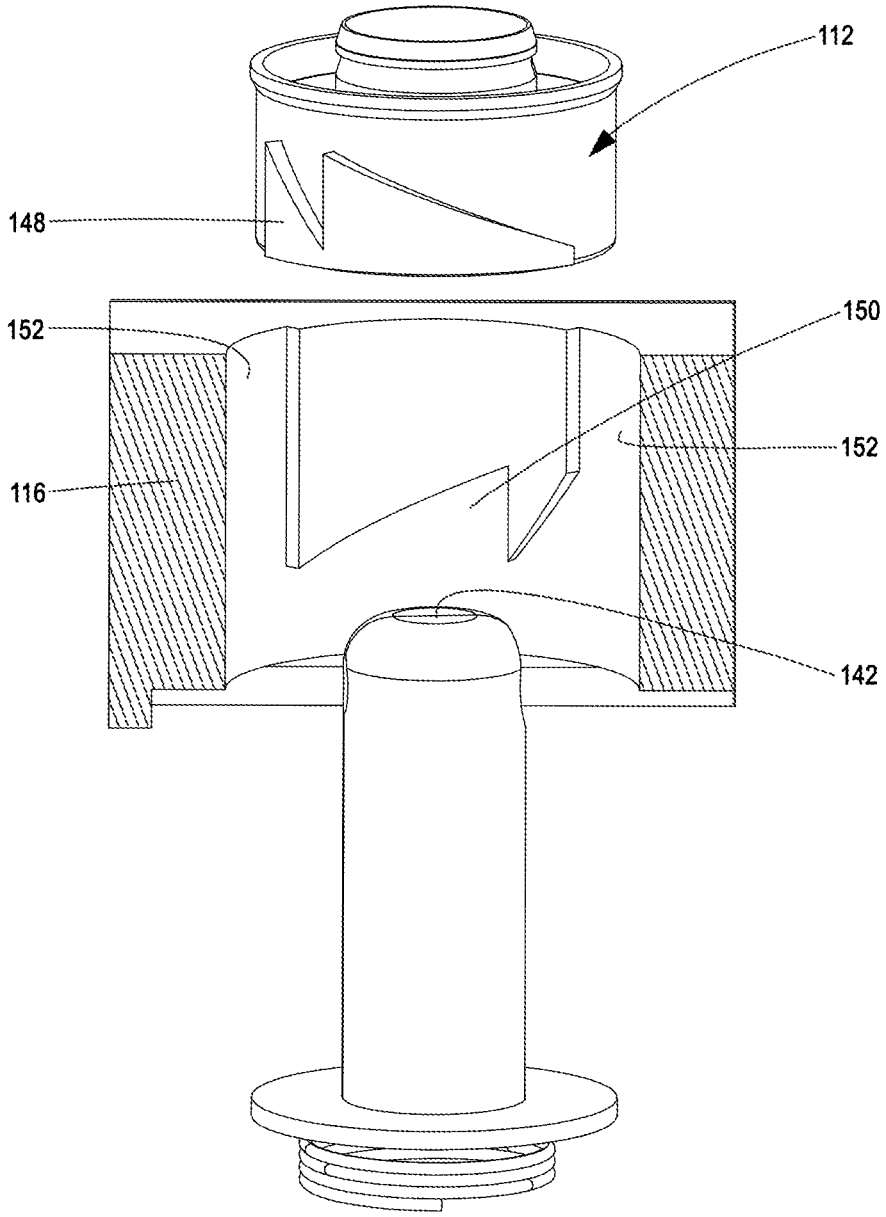
FIG. 6 is a partial cross-sectional perspective view of a fluid dispensing apparatus according to an alternative embodiment of the first aspect of the invention.

An alternative arrangement for the second securing means is shown in FIG. 6. This securing means is similar to an actuator for a retractable pen nib. The cap 112 defines saw-tooth shaped radial protrusions 148 that co-operate with saw-tooth shaped recesses 150 defined by the radial wall of the seat 116. The seat 116 also defines longitudinally extending grooves 152 to receive the radial protrusions 148 of the cap 112 therein and permit such protrusions 148 to travel therealong. Relative rotation of the cap 112 and seat 116 causes the radial projections 148 defined by the cap 112 either: (i) to be captured by a saw-tooth shaped recess 150 defined by the seat 116; or (ii) to be permitted to travel along a groove 152 to remove the cap 112 from the seat 116.

Returning to FIGS. 1 to 5, a probe 34 is located within the seat 16 and extends axially. The probe 34 is sized and shaped to pass through the aperture 24 defined by the cap 12 as the cap 12 is received within the seat 16, and hingedly displace the cover 26, thereby permitting the probe 34 to access the fluid 22 within the bottle 14.

A gas conduit 36 is connected to a pressurised carbon dioxide cylinder 38 at one end and extends at least partially along the probe 34, exiting the probe 34 at a port at or near the free end of the probe 34. When the probe 34 is located within a bottle 14, the gas conduit 36 charges the interior of the bottle 14 with carbon dioxide gas.

A valve 40 is located along the gas conduit 36 for regulating the flow of gas along the gas conduit 36.

A sensor comprising:

(i) a formation (such as the radially protruding tabs 28) on the cap 12; and (ii) a formation (such as a switch located at the end of the groove 32) on either the seat 16 or the probe 34 that co-operates with the formation on the cap 12, senses whether the cap 12 has been secured to the seat 16. Should the sensor sense that the cap 12 is secured to the seat 16, the gas conduit valve 40 is opened. Alternatively, should the sensor sense that the cap 12 is not secured to the seat 16, the gas conduit valve 40 is closed. As such, securing the cap 12 to the seat 16 automatically causes the bottle 14 to be pressurised with carbon dioxide gas.

It will be appreciated that the sensor could take various forms, for example, the sensor could comprise a nipple at or near the end of the groove 32 that is depressed as the radially protruding tab 28 engages it. Furthermore, the probe could be incorporated into the probe 34, whereby insertion of the probe 34 through the aperture 24 defined by the cap 12 could cause the probe 34 to depress and open the gas conduit valve 40. Alternatively, the sensor could comprise a proximity sensor that senses proximity of the cap 12 to the seat 16 (e.g. an infra-red sensor or a break-beam sensor).

A fluid outlet conduit 42 extends from at or near the free end of the probe 34, at least partially along the probe 34. A cellar buoy 44 is located along the fluid outlet conduit 42 and a one-way valve 46 is also located therealong, operatively downstream of the cellar buoy 44. The cellar buoy 44 prevents gas from traveling from the bottle 14 along the fluid outlet conduit 42 when the bottle 14 is empty of liquid beverage 22. Whereas, the one-way valve 46 prevents reverse flow of fluid 22 along the fluid outlet conduit 42, back towards the bottle 14.

Figure 7:
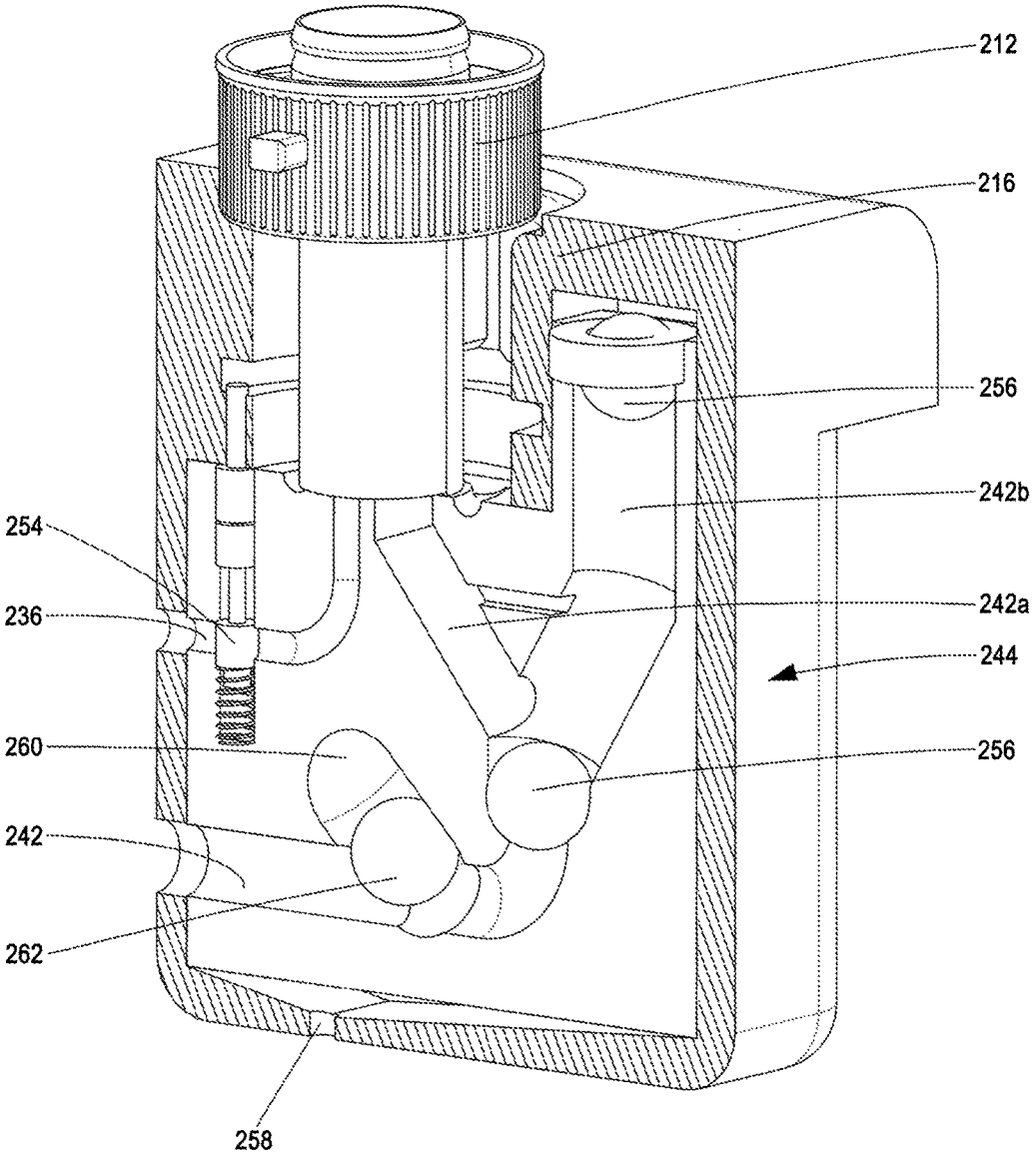
FIG. 7 is a partial cross-sectional perspective view of an alternative arrangement of a gas conduit and fluid outlet conduit forming part of a fluid dispending apparatus.
Figure 8:
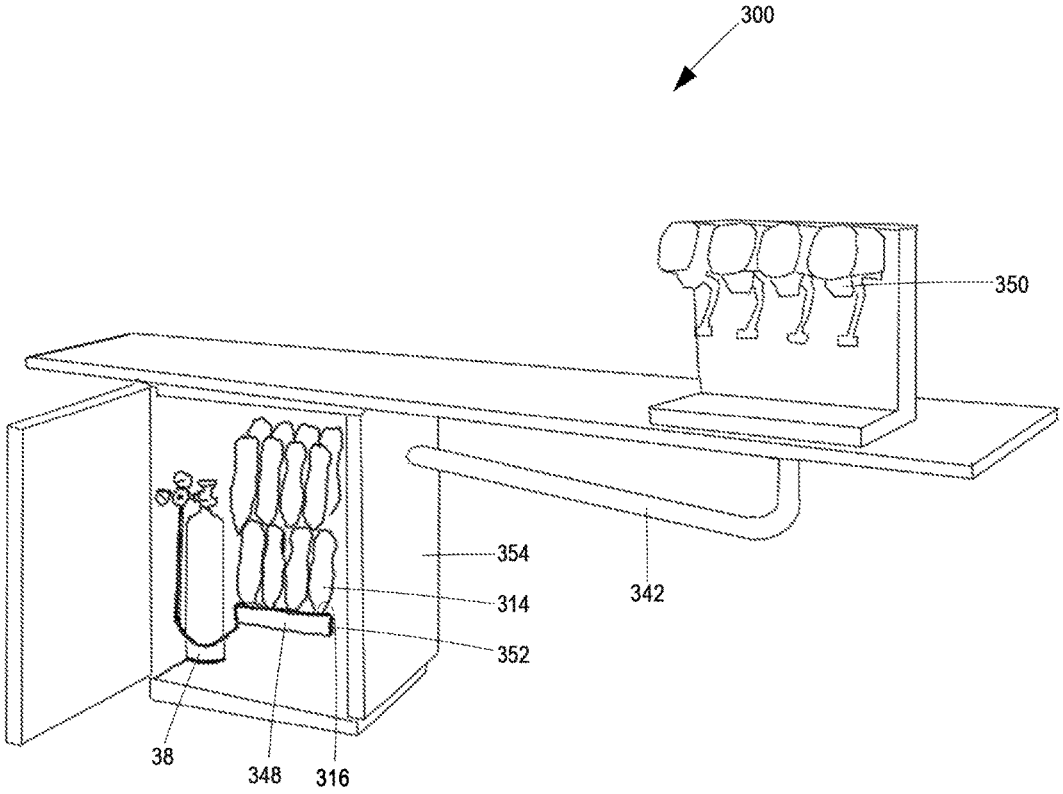
FIG. 8 is a side view of a fluid dispensing system according to a second aspect of the invention.

It will be appreciated that a flow regulator other than a cellar buoy may be used. FIG. 7 shows an alternative arrangement of a flow regulator 244 comprising a gas conduit 236 and fluid outlet conduit 242. Flow through the gas conduit 236 is regulated by a valve 254 that is actuated by receipt of the cap 212 within the seat 216. The fluid outlet conduit 242 defines a primary conduit **242*a* and a subsidiary branch conduit 242***b*. A pair of buoyant balls 256 (i.e. having a specific gravity less than 1) is trapped within the subsidiary branch conduit 242*b*. In the presence of liquid, these buoyant balls 256 rise up the subsidiary branch conduit 242*b*, thereby restricting flow of fluid upwards along the subsidiary branch conduit 242*b*. Fluid that passes through the subsidiary branch conduit 242*b* is discharged via the waste fluid discharge outlet 258. In use, fluid that is discharged from the container (not shown) and enters the fluid outlet conduit 242 principally travels along the primary conduit 242*a*. The flow regulator 244 defines an antechamber 260 along the primary conduit 242*a*. Located within this antechamber is a third ball 262 with a specific gravity greater than 1. This third ball 262 seals the primary conduit 242*a* when fluid ceases to flow therealong in a direction away from the seat 216.

With reference to FIGS. 1 to 5 and FIG. 8, a fluid dispensing system 300 comprises:

(i) at least two fluid dispensing apparatuses 10 according to the first aspect of the invention shown in FIGS. 1 to 5; and (ii) a manifold 348 for combining the at least two fluid outlet conduits 42 into a single fluid conduit 342 that terminates at its operative downstream end in a fluid dispensing tap 350.

The multiple seats 316 are located on/defined by a single base 352. And, a refrigerated container 354 housing the bottles 314 connected to the manifold 348 to keep them cool.

In use, the cap 12 is secured to the mouth of a bottle 14, the bottle 14 is inverted and the cap 12 is located within and secured to the seat 16. While locating the cap 12 within the seat 16, the probe 34 protrudes through the aperture 24 defined by the cap 12 and into the bottle 14. The process of securing the cap 12 to the seat 16 causes the gas conduit valve 40 to open and pressurise the bottle 14 with carbon dioxide gas. As the fluid dispensing tap 350 is opened, the fluid 22 exits the bottle 14 and travels along the fluid outlet conduit 142, past the cellar buoy 44/flow regulator 244 and one way valve 46. Upon reaching the manifold 348, the fluid 22 in the fluid outlet conduits is combined and conveyed to the fluid dispensing tap 350.

The invention claimed is:

1. A fluid dispensing apparatus including: a cap for covering a mouth of a container;

first securing means for, in use, securing the cap to the mouth of the container;

a cover on the cap for, in use, regulating flow of fluid from the container on which the cap is secured through the cap, the cover being in the form of a cap valve that is movable between: (i) a closed condition in which the cap valve prevents access to the interior of the container and seals the container; and (ii) an open condition in which the can valve permits access to the interior of the container;

a seat for, in use, receiving the cap or the container to which the cap is secured therein;

second securing means for, in use, securing either the cap or the container to which the cap is secured to the seat;

a probe located within the seat for, in use, moving the cap valve from the closed condition to the open condition when the cap or the container to which the cap is secured is received in the seat, and thereby permitting access to the interior of the container;

a gas conduit for, in use, charging the container associated with the cap with gas;

a gas valve for regulating flow of gas through the gas conduit;

a sensor for sensing whether the container or the cap is secured to the seat, which sensor causes the gas valve to: (i) open when the container or the cap is secured to the seat; and (ii) close when the container or the cap is not secured to the seat; and a fluid outlet conduit that extends at least partially along the probe.

2. A fluid dispensing apparatus according to claim 1, wherein the sensor comprises a formation on the cap that co-operates with a formation on the seat or the probe to open the gas valve when the container or the cap is secured to the seat.

3. A fluid dispensing apparatus according to claim 2, wherein the formation on the cap is a radially projecting tab.

4. A fluid dispensing apparatus according to claim 3, wherein the gas conduit extends at least partially along the probe.

5. A fluid dispensing apparatus according to claim 4, further including a flow regulator that is located along the fluid outlet conduit.

6. A fluid dispensing apparatus according to claim 5, wherein the flow regulator comprises: (i) a portion of the fluid outlet conduit; (ii) a subsidiary branch conduit that is in fluid communication with the portion of the fluid outlet conduit, the subsidiary branch conduit terminating in a waste fluid discharge outlet; and (ii) at least one buoyant ball trapped within the subsidiary branch conduit.

7. A fluid dispensing apparatus according to claim 6, wherein the flow regulator further: (i) defines an antechamber along the portion of the fluid outlet conduit; and (ii) includes a ball with a specific gravity greater than 1 located within the antechamber.

8. A fluid dispensing apparatus according to claim 5, further including a one-way valve located along the fluid outlet conduit.

9. A fluid dispensing apparatus according to claim 8, wherein the first securing means comprises a female threaded portion for, in use, co-operating with a male threaded portion adjacent the mouth of the container.

10. A fluid dispensing apparatus according to claim 9, wherein the second securing means comprises the radially projecting tab on the cap, which tab co-operates with the receiving formation defined by the seat.

11. A fluid dispensing apparatus according to claim 10, wherein the receiving formation defined by the seat is a groove sized to receive the radially projecting tab on the cap therein and therealong.

12. A fluid dispensing apparatus according to claim 11, wherein the cap valve comprises an aperture defined by the cap and a cover that is hingedly connected to the cap for covering the aperture.

13. A fluid dispensing apparatus according to claim 12, wherein the gas conduit is connected at one end to a pressurised carbon dioxide gas cylinder.

14. A fluid dispensing apparatus according to claim 12, wherein the container is a bottle.

15. A fluid dispensing apparatus according to claim 14, wherein the bottle is a 2, 1.5, 5, 10 or 20 liter bottle.

16. A fluid dispensing system including at least two fluid dispensing apparatuses according to claim 14 and a manifold for combining the at least two fluid outlet conduits into a single fluid conduit that terminates at its operative downstream end in a fluid dispensing tap.

17. A fluid dispensing system according to claim 16, further including a base: (i) on which at least two seats are located; or (ii) that defines at least two seats.

18. A fluid dispensing system according to claim 17, further including a refrigerated container for, in use, housing at least two containers associated with the at least two caps.

* * * * *